US005590918A

United States Patent [19]

Kambalov

[11] Patent Number: 5,590,918

[45] Date of Patent: Jan. 7, 1997

[54] DEVICE AND METHOD FOR SECURING DOORS AGAINST FORCED BREAK-INS

[76] Inventor: Sergei Kambalov, 24 Beechwood Rd., Hartsdale, N.Y. 10530

[21] Appl. No.: 444,695

[22] Filed: May 19, 1995

[51] Int. Cl.[6] ..... E05C 5/02

[52] U.S. Cl. ..... 292/60; 292/DIG. 15; 16/82

[58] Field of Search ..... 292/164, DIG. 15, 292/342, 175, 60; 16/82

[56] References Cited

U.S. PATENT DOCUMENTS

| | | | |
|---|---|---|---|
| D. 229,165 | 11/1973 | Wormood . | |
| 504,207 | 8/1893 | Fowler . | |
| 1,828,912 | 10/1931 | Tobin . | |
| 2,586,465 | 2/1952 | Hitschmann . | |
| 2,665,161 | 1/1954 | Stehling . | |
| 2,687,548 | 8/1954 | Price | 292/DIG. 15 X |
| 2,929,647 | 3/1960 | Gladstone . | |
| 3,330,585 | 7/1967 | Pollin . | |
| 3,791,687 | 2/1974 | Schroeder | 292/DIG. 15 X |
| 4,082,332 | 4/1978 | Palmer . | |
| 4,178,026 | 12/1979 | Sinkhorn . | |
| 4,335,910 | 6/1982 | Massie . | |
| 4,343,500 | 8/1982 | Steiner . | |
| 4,429,911 | 2/1984 | O'Neal et al. . | |
| 4,462,623 | 7/1984 | Grant . | |
| 4,576,423 | 3/1986 | Hendriks . | |
| 4,601,502 | 7/1986 | Van Dyke . | |
| 4,765,664 | 8/1988 | Siegel . | |
| 4,867,493 | 9/1989 | Ward | 292/DIG. 15 X |
| 5,120,093 | 6/1992 | Carney . | |
| 5,199,759 | 4/1993 | Anderson . | |
| 5,383,254 | 1/1995 | Wigley, Sr. | 292/DIG. 15 X |
| 5,454,143 | 10/1995 | Wigley | 16/82 |
| 5,490,304 | 2/1996 | Winner, Jr. et al. . | |

FOREIGN PATENT DOCUMENTS

| | | |
|---|---|---|
| 1011367 | 5/1977 | Canada . |
| 1909561 | 11/1969 | Germany . |
| 530364 | 7/1955 | Italy . |
| 2030639 | 4/1980 | United Kingdom . |

*Primary Examiner*—Rodney M. Lindsey
*Attorney, Agent, or Firm*—Martin A. Farber

[57] ABSTRACT

Door securing device and method comprising a cam having a periphery, a shaft perpendicularly connected to the cam, and a socket adapted to be formed in a floor adjacent a door. The shaft is operatively pivotally mounted in the socket with the periphery of said cam abutting the door. The socket secures the shaft therein and the cam abutting the door against breaking the door in. While maintaining the securing of the shaft, cam and door against break-ins, the shaft is pivotal in the socket, without removing the shaft from the socket, to and from respective selected pivot positions of the shaft in the socket, in which positions a respective portion of the periphery of the cam abuts the door in a completely closed position of the door, and respectively, in at least one partially open position of the door. The shaft is removably mounted in the socket for removal when desired.

20 Claims, 3 Drawing Sheets

DEVICE AND METHOD FOR SECURING DOORS AGAINST FORCED BREAK-INS

FIELD AND BACKGROUND OF THE INVENTION

The invention relates to a securing device and method for securing doors against forced break-ins, in general. Such a securing device protects doors from being forced in from the outside.

Devices are known for protecting doors from being forced open, such as door chains, the POLICE LOCK, and the DOORCLUB (t.m.).

The known devices are inadequate to permit a small opening of the door while keeping the door secured against forced entry. The POLICE LOCK does not provide this flexibility. It has to be engaged at all times and does not allow the door to be opened to a limited degree at all.

Door chains and the DOORCLUB could both be disabled rather easily once the door is unlocked and partially opened. A chain, even if it is strong enough to withstand force and not to rupture, could easily be sawn through or cut with a metal cutter. The DOORCLUB could be disabled through a partially or cracked-opened door using a very primitive tool (a metal rod bent into Z-form at an angle). Disabling a door chain or a DOORCLUB becomes particularly easy if the occupant is incapacitated, by Mace, for example, through the door opening.

The principal weakness of the DOORCLUB design is that it is functional in only two fixed positions: (1) when it is flush against the door thus preventing any movement of the door while supporting it from being forced in; and (2) when reversed, it permits the door to be opened a little while continuing to protect it from being forced in. The crucial fault is that when changing from position (1) to position (2) or vice-versa one must lift the DOORCLUB out of its floor socket, thus temporarily disabling the protection while it is out of its floor socket. This instant could be sufficient for someone to force the door in. Although the DOORCLUB can be pivoted in the floor if the door were out of the way, e.g. completely open, the DOORCLUB can not be pivoted from position (1) to position (2) since the closed door prevents pivoting of the DOORCLUB. That is the DOORCLUB only can undergo a non-functionally pivoting if the DOORCLUB is not against the door.

SUMMARY OF THE INVENTION

The principal object of the present invention is to provide a securing device and method for securing doors against forced break-ins, which secures a completely closed door as well as permits the selective opening of the door to a certain limited extent (e.g. a crack, to accept letters, or a larger but still relatively small opening to accept packages) while at the same time never, not even for an instant, compromising protection, not even while changing from one position to another position.

According to the invention there is provided a securing device comprising a pivotable cam which is abutable against a door in selective operative door locking positions by correspondingly pivoting the cam which is rotatably mounted via its pivot shaft, pivotally inserted in a floor socket. The socket secures the shaft therein and the cam abutting the door against breaking the door in.

According to a feature of the invention means are provided for preventing the cam from being removed from the socket in the operative door locking positions as well as while the cam is being pivoted between locking positions.

In another feature of the invention the preventing means comprises a spring which presses a stop on the pivot shaft up into an engagement slot in a head piece secured in the floor socket, whereby the cam is locked in position.

It is still another feature of the invention to provide in the head piece a release slot located at an angular position from the engagement slot, the release slot extending completely through the top of the head piece, and adapted to permit the stop to pass therethrough when the shaft is pivoted to a position in which the stop is aligned with the release slot, whereby the cam-shaft unit can be removed from the socket.

The present invention, to the contrary of the known devices, can not be disabled from the outside since this would require a complex, composite action (e.g. downward pressure on the pivot shaft to withdraw the stop from the engagement slot and a rotating of the device to align it with the release slot) whereby the securing device of the invention remains firmly in its socket at all times.

According to yet another feature of the invention a plurality of engagement slots are provided at different angular positions in the head piece corresponding to the selective operative locking positions of the cam abutting against the door at different spaced positions from the door frame, which permit the door to be opened up to predetermined relatively small open positions and a completely closed position of the door, while in each position the device of the invention secures the door from being forced in even while the cam is being pivoted from one position to another position.

A principal functional part of the door securing device of the present invention is the male cam-shaft unit. The cam is horizontally mounted, and preferably is a triangular-shaped cam with rounded angles attached to an eccentrically disposed pivot shaft which extends vertically into the floor socket.

Another principal part of the door securing device of the invention is the female socket which comprises the socket into which the pivot shaft is pivotally insertable and the head piece fixedly mounted in a floor.

According to a simplified embodiment of the invention, the head piece can be omitted.

According to another feature of the invention a tube may be inserted into the socket, and the shaft is pivotally inserted into the tube. The tube may optionally be connected to the head piece.

The proper relation of sizes of the three sides of the cam and of the angles is determined from the desired degree(s) of selective door opening, while simultaneously preventing the door from being forced-in.

BRIEF DESCRIPTION OF THE DRAWINGS

With the above and other objects and advantages in view, the present invention will become more clearly understood in connection with the detailed description of preferred embodiments, when considered with the accompanied drawings which are presented as illustrations only, of which.

DETAILED DESCRIPTION OF THE PREFERRED EMBODIMENTS

Figure 1:
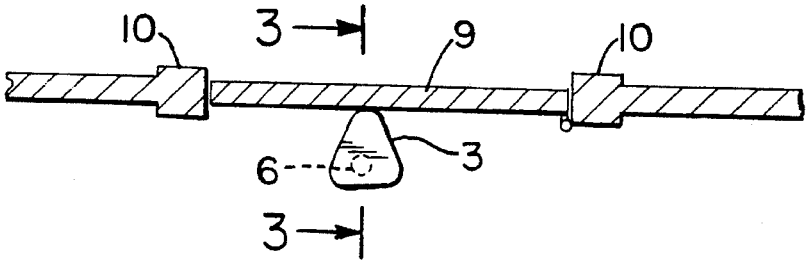
FIG. 1 is a top plan view of the cam and shaft part of the door securing device of the invention, taken along the lines 1—1 of FIG. 3, in a first operative locking position (1) securing the door, in a completely closed position against any opening of the door.
Figure 2:
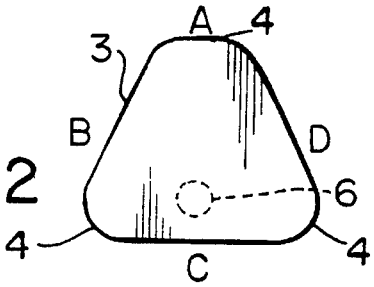
FIG. 2 is an enlarged top plan view of the cam and shaft part of the door securing device of FIG. 1.
Figure 3:
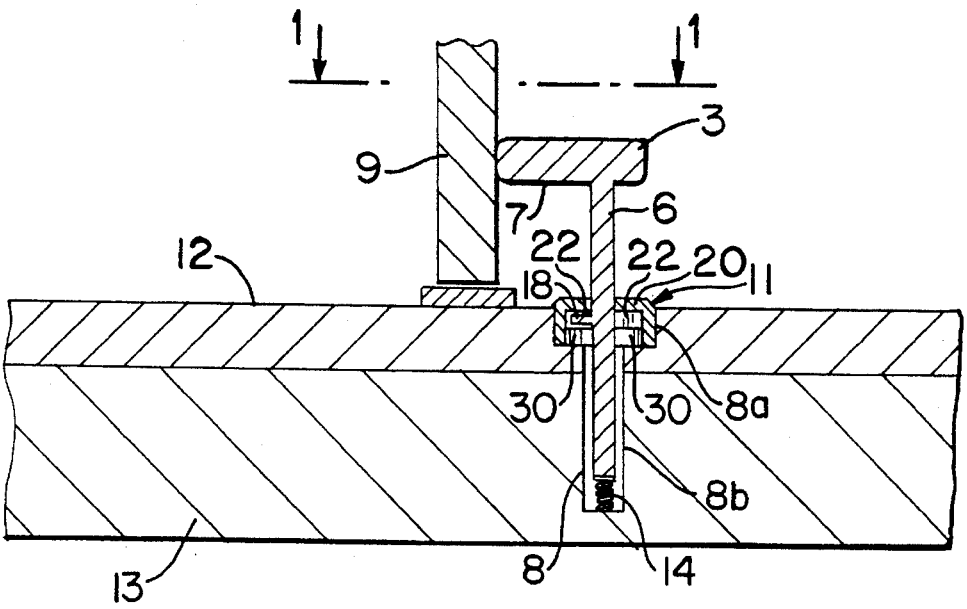
FIG. 3 is a sectional view of the door securing device in the position of FIG. 1 taken along the lines 3—3 of FIG. 1.

Referring to FIGS. 1–8, the door securing device of the invention comprises a preferably triangular-shaped cam 3 formed with rounded apexes 4 and a shaft 6 perpendicularly eccentrically connected thereto, and projecting from a bottom side 7 of the cam 3. The cam 3—shaft 6 unit thus forms a one-piece integral assembly unit. The invention is not limited to a triangular-shaped cam and cams with more sides or different shapes may be used. The periphery of the cam defines sides A, B, C, D (FIG. 2). In operative position the shaft 6 extends into a socket 8 as shown in FIG. 3, or into a metal tube 5 (which is optimal—shown in FIG. 4) mounted in the floor socket 8, by which the cam 3 is eccentrically pivotally mounted at its pivot point which is defined by the eccentric connection point of the shaft 6 to the cam 3. The floor socket 8 can be an opening or bore in the floor 12 or the floor 12 and subfloor 13 or a tube-like casing. The floor socket 8 in the illustrated embodiment comprises two bores 8*a*, 8*b* of different diameters. The top bore 8*a* is a larger diameter bore to accommodate a head piece 11, and the lower bore 8*b* is a smaller diameter bore to accommodate the shaft 6. The tube 5 may be omitted in such embodiment as shown in FIG. 3.

The securing device has several, e.g., in the embodiment shown, three operative locking positions and one release-removal/insertion position (in other embodiments it can have two operative locking positions, or even four or more operative locking positions). The securing device has the following, selectively pivoted, cam operative locking and release positions with the triangular cam of FIGS. 1–8:

Position 1 (FIGS. 1, 3), Side A of cam 3 flushly abuts against door 9 with the door secured thereby in its completely closed position in door frame 10 and door threshold or saddle 15. So no door movement is possible.

Figure 5:
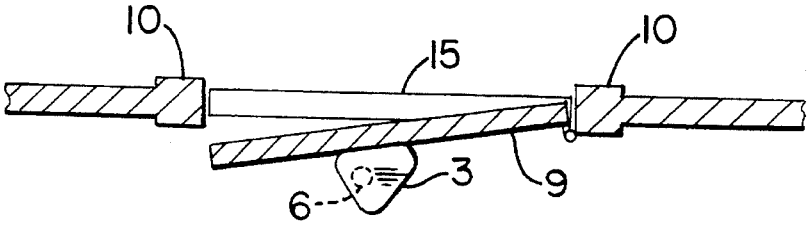
FIG. 5 is a top plan view showing the cam and shaft part of the door securing device similar to FIG. 1, but in operative locking position (2) permitting a cracked open position of the door.

Position 2 (FIG. 5). Side B of the cam 3 abuts against the door 9 when the door is slightly open, e.g. to receive a letter. In this position very limited door opening is permitted, but no more. In this position, in the illustrated embodiment, the cam 3 has been pivoted less than 90° clockwise with respect to the position of the cam in FIG. 1.

Figure 6:
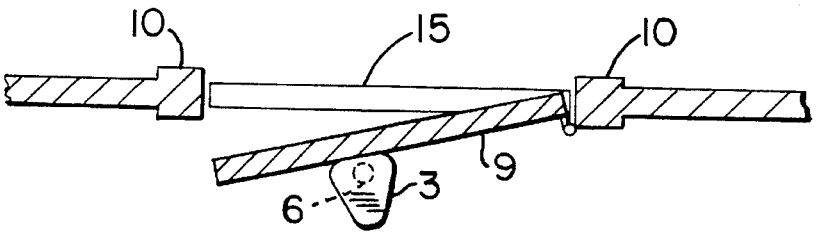
FIG. 6 is a top plan view showing the cam and shaft part of the door securing device similar to FIG. 1, but in operative locking position (3) permitting a slightly wider open position of the door.
Figure 7:
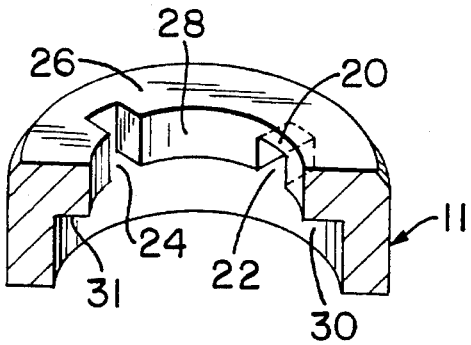
FIG. 7 is a perspective view of the head piece broken away in 180° for ease of viewing.

Position 3 (FIG. 6). Side C of the cam 3 abuts against the door 9, such that the door could be opened wider then Position 2, for example only enough to accept a small package, while not compromising security since the door can not be opened more. In this position the cam 3 has been pivoted less than 180° clockwise with respect to the position of the cam in FIG. 1.

Figure 8:
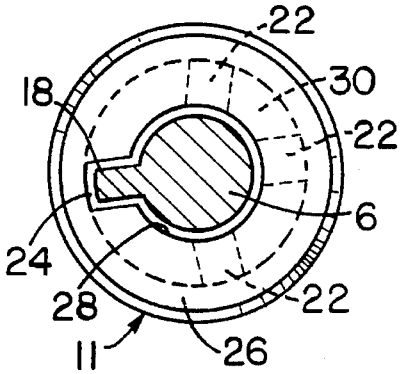
FIG. 8 is a top view of the head piece taken along the lines 8—8 of FIG. 4 showing the stop of the shaft of the door securing device in the insertion/release-removal position.
Figure 4:
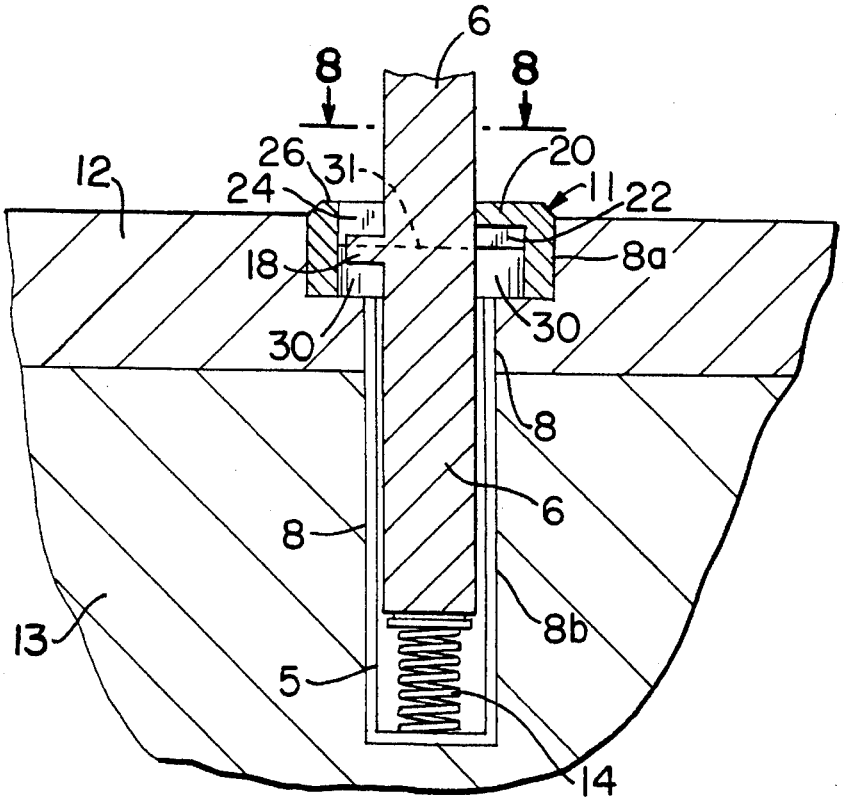
FIG. 4 is an enlarged sectional view broken away in part, similar to FIG. 3 but showing the lower portion of the door securing device inserted in the floor socket modified with a tube in the socket, and with the door securing device in the release-removal/insertion position.

Position 4 (FIGS. 4, 8). Side D of the cam faces the door 9. This position is the only release (removal) position or insertion position, in which the cam 3 and shaft 6 portion of the securing device can be lifted out from its socket 8 or inserted therein, respectively. In this position, in the illustrated embodiment, the cam 3 has been pivoted by less than 270° (although embodiments of pivoting of other angles are possible) clockwise with respect to the position of the cam in FIG. 1.

The proper relation of sizes and angles (sides A, B, C) are set to provide the desired degrees of door opening.

The change from one position to another is achieved by rotating the horizontally oriented cam 3 in its horizontal plane with the shaft 6 disposed safely in the socket 8 or in the tube 5 in the socket 8.

The cam 3 is formed, such that, as it is pivoted from the closed door position 1 of FIG. 1 to the partial open door positions 2 and respectively 3 of FIGS. 5 and 6, the distance from the portion of the periphery of the cam abutting against the door 9 to the pivot point (shaft 6) decreases continuously, whereby the door can correspondingly be opened wider and these protected (secured) positions of the door can be achieved without removing the shaft 6 from the socket 8 by the invention. This provides security against breaking the door in at all times even while pivoting from one position to another since the shaft 6 is always in the socket 8 while the cam 3 can always abut against the door (this is the meaning of the term "operatively pivotally mounted" as used in the claims).

To preclude the unintended removal of the male cam—shaft assembly of the door securing device from the floor socket 8, the bottom part, the female part, of the door securing device comprises the floor socket 8 (FIG. 1) or the metal tube 5 which is inserted into the floor socket 8 (FIG. 4). The head piece 11 is securely attached to the floor 12 in the floor socket 8. The head piece 11 may also be connected to the top of the tube 5 at the floor level (FIG. 4). The head piece 11 is arranged with its top 26 at about the level of the surface of the floor 12. The head piece 11 is fixedly mounted in the upper bore 8*a* in the floor socket 8, by attaching it below the floor level, e.g. to subfloor 13 or floor 12 by fastening means (not shown) such as e.g. screws, or other fastening devices, so as to fixedly (non-rotatably and non-liftably, non-removably) hold the head piece 11 in the upper bore 8*a* of the socket 8 in the floor.

A compression spring 14 is positioned at the bottom of the tube 5 in the socket 8 (FIG. 7) and presses the bottom of the shaft 6 in an upward direction. The shaft 6 has secured thereto a horizontally protruding stop 18 which, when the cam 3 is selectively pivoted, engages into one of four vertical slots, namely three operative locking position engagement slots 22 (corresponding to Positions 1–3 above) and one release/insertion slot 24 (corresponding to Position 4), which slots are provided in the bottom part of the head piece 11. Only one release slot 24 is provided which extends vertically and completely from the bottom through the top 26 of the head piece 11, thus permitting the insertion in, or lifting out of the entire cam 3–shaft 6 assembly from, the tube 5 of the socket 8 (FIGS. 4 and 8). When the stop 18 is located in one of the three operative locking position engagement slots 22, the securing device 1, namely the cam 3–shaft 6 assembly is fixed in one of the securing Positions 1–3.

The shaft 6 is rotatable in the floor socket 8 from slot to slot only when the stop 18 is at the horizontal level of a "free rotation track", formed as an annular recess 30, in the bottom of the head piece 11. This track or recess 30 communicates with the bottom of the slots 22, 24.

To achieve this, the entire cam 3—shaft 6 unit has to be pressed down by the occupant against the force of the spring 14 until the stop 18 enters the recess 30. Then the cam 3—shaft 6 unit can be pivoted whereby the stop 18 travels along the track 30. While the stop 18 travels along the track the cam-shaft unit is still in operative condition preventing door break-ins since the cam is in position with the shaft in the socket 8 and it can not be removed from the socket 8 because the stop 18 is prevented from being lifted with the shaft 6 by upper wall 31 of the recess 30.

Once the stop 18 has reached a position adjacent any of the three operative locking engagement slots 22 or the single release slot 24, the downward pressure can be released by the occupant and the cam-shaft unit of the securing device is pressed upwardly by the spring 14 so that the stop 18 enters and is held fixed in one of the three operative positions in engagement slots 22, or respectively, the cam-shaft unit can be removed for storage by passing through the release slot 24.

The head piece 11 is similar to a round washer but rather thick. It has the four slots 22, 24 in its inner wall 28 and upper wall 31 at predetermined angular intervals. The shaft 6 also guidingly and pivotally extends through the tubular opening formed by the annular inner wall 28 of the head piece 11. The release slot 24, corresponding to side D (FIG. 2), extends all the way from the bottom to the surface top 26 of the head piece 11. The other three slots 22 (corresponding to sides A, B, and C of the cam 3 engaging against the door in the corresponding Positions 1–3 when the stop 18 is in registry with the respective slot 22) do not extend through to the top of the head piece 11, but are blind slots enclosed at their top by top wall 20 of the head piece 11. By this, when the stop 18 is in one of these three top-blind slots 22, the male cam-shaft unit of the securing device can not be lifted out of the tube 5 or the socket 8 since the stop 18 (and thereby the shaft 6) is blocked from upward removal movement by the top wall 20 of the head piece 11 at the top of the slots 22. The width of the slots 22 is essentially the same as the width of the stop 18 so essentially no pivotal movement of the cam 3 can occur when the stop 18 is engaged in any of the slots 22.

When the whole cam-shaft assembly is pressed down against the spring 14 at the bottom of the tube 5, the shaft 6 rotates and the stop 18 travels freely in the annular recess 30. When the downward pressure is released when the stop 18 is under a slot 22, the stop 18 enters into one of the three slots 22 (corresponding to sides A, B, or C), thus fixing the door device 1 in one of the three operative locking positions 1–3. To remove the securing device 1, it is pressed down against the force of the spring 14 until the stop 18 leaves the engaged slot 22 and enters into the annular recess track 30. The shaft 6 can then be rotated until the stop 18 is vertically aligned under the release slot 24. The downward pressing of the securing device 1 is now released and the spring 14 pushes the stop 18 up through the release slot 24, where the securing device 1 can be lifted out of the socket 8 and put away.

Figure 10:
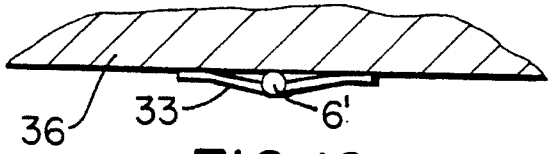
FIG. 10 is a top view of the top bracket of FIG. 9.
Figure 9:
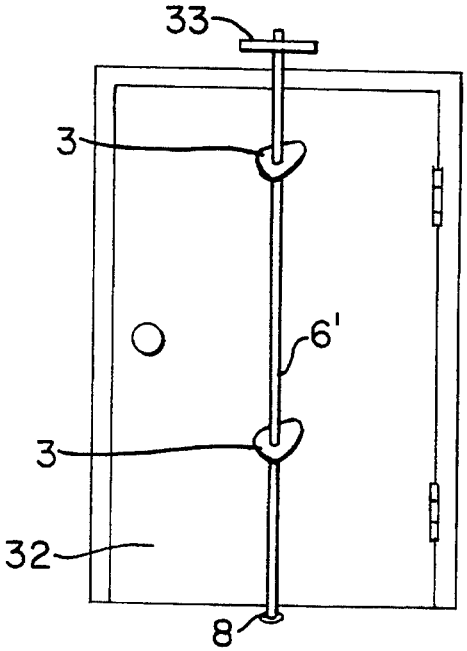
FIG. 9 is elevational, perspective schematic view of another embodiment of the door securing device of the invention.

Referring now to FIGS. 9 and 10, another embodiment of the invention is illustrated which provides additional strength and security. The shaft 6' extends all the way to the top of the door (extending from and fixedly connected to the top and bottom of the cams 3) and employs two (or more) of the cams 3, one at the bottom and another cam 3 closer to the top of the door 32 (FIG. 9). The door is thus protected from being forcibly removed from its hinges 35 and pushed over from the top, flat onto the floor. The construction of the bottom socket 8 is identical to that described above in the embodiment of FIGS. 1–8. On the top, the shaft 6' is inserted into a bracket 33 (FIG. 10) mounted on wall 36. To remove the cam-shaft assembly of the securing device, the shaft 6' is pressed down (against the spring 14, not shown, in the floor socket 8) so that its top disengages from the bracket 33. Then the cam-shaft assembly is removed after it is pivoted as described in the first embodiment of FIGS. 1–8. In a modification of this embodiment a top socket can be located in a socket in the ceiling depending on location requirements (instead of the bracket 33 of FIG. 9 on the wall 36).

Figure 11:
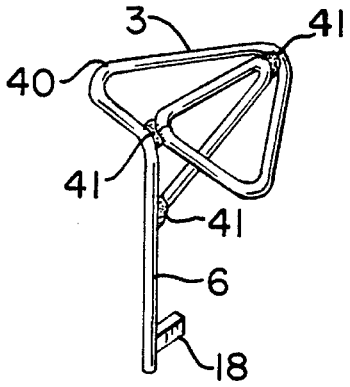
FIG. 11 is a perspective view of another embodiment of the cam-shaft unit.

The securing device of the invention can be made of various materials. It can also be made out of either strong resilient rubber (similar to the type of material comprising e.g. rubber mallets) or metal rod. Metal rod strong enough to withstand the stress is preferred for the cam and shaft assembly since manufacture would be inexpensive since it would only involve bending one continuous piece of metal rod 40 and three to four points of welding 41 (FIG. 11). Various other designs for bending and welding the one-piece length of rod are contemplated. Such a configuration provides sufficient resilience and strength, metal also looks better than rubber, and is easier to store (e.g. hang) when not in working position.

The depth of the floor opening (socket 8) necessary to reliably house the tube 5 and vertical shaft 6 (and the dimensions of the shaft) are determined based on the characteristics (strength, resilience) of the material used for the shaft. It is possible that as little as two inches would be sufficient, possibly deeper. The three angles (or apexes) of the triangle shape of the cam should be rounded (not pointed) to facilitate rotation.

In addition to the above-described embodiments, there is a basic simplified embodiment of the securing device, in which the socket 8 does not contain the spring 14 nor the larger bore 8*a*, nor the head piece 11 with the slots 22 of FIGS. 1, 4, 7 and 8 for restricting withdrawal of the cam-shaft unit from the floor socket, nor does the shaft contain the stop 18. This simplified device still enables the selective operative door locking positions 1–3 of FIGS. 1, 5 and 6 while the socket 8 secures the shaft 6 therein and the cam 3 abutting the door 9 against breaking the door in. This embodiment is suitable for institutional customers (hotels, etc.) where it may be problematic properly to instruct the transient users about the release procedure ("press down, rotate to position C, etc."). This basic function of the device will prevent the door from being forced-in in any position and while pivoting the cam-shaft unit from one position to another so long as the shaft 6 is in the socket 8, but without the additional protection against its malevolent withdrawal through a partially opened door.

While features of the invention have been described in detail, further modification is understood and the invention is not limited to these features, but only within the scope of the invention as claimed herein.

I claim:

1. A door securing device comprising a cam having a periphery, a shaft substantially perpendicularly connected to the cam, a socket, adapted to be formed in a floor adjacent a door, said shaft being operatively pivotally mounted in said socket with the periphery of said cam abutable against the door preventing against pushing the door in constituting a door security condition, said shaft being pivotal in said socket while in said door security condition without removing said shaft from said socket from and to respective selected pivot positions of said shaft in said socket, and in the respective selected pivot positions of said shaft in said socket, respective portions of said periphery of said cam abut said door in a completely closed position of the door, and respectively, in at least one partially open position of the door, preventing against pushing the door in.

2. A door securing device according to claim 1, further comprising means for preventing withdrawal, even with a tool, of said shaft from said socket in said respective selected pivot positions and therebetween in said door security condition.

3. A door securing device according to claim 2, wherein said means prevents withdrawal movement of said shaft from said socket when pivoting said shaft in said socket to and from said pivot positions, respectively.

4. A door securing device according claim 2, wherein said means defines a release, pivot position wherein when said shaft is in said release, pivot position said shaft is removable from said socket.

5. A door securing device comprising a cam having a periphery, a shaft perpendicularly connected to the cam, a socket, adapted to be formed in a floor adjacent a door, said shaft is operatively pivotally mounted in said socket with the periphery of said cam abutting the door, said shaft being pivotal in said socket without removing said shaft from said socket such that in respective selected pivot positions of said shaft in said socket, a respective portion of said periphery of said cam abuts said door in a completely closed position of the door, and respectively, in at least one partially open position of the door, said socket securing the shaft therein and the cam abutting the door against breaking the door in, means for preventing withdrawal of said shaft from said socket in said pivot positions, said means defines a release, pivot position wherein when said shaft is in said release, pivot position said shaft is removable from said socket, and said means comprises:

a stop on said shaft;

a head piece fixedly secured in said socket and having a plurality of engagement slots, each of said slots is a blind slot covered at its upper end in said head piece, said plurality of slots are located such that in said respective selected pivot positions of said shaft, said stop engages a respective one of said slots; and a spring disposed in said socket biasing said shaft and said stop against the upper end of said respective slot in said respective selected pivot positions, thereby preventing withdrawal of the shaft from said socket.

6. A door securing device according to claim 5, wherein said head piece defines one release slot in a predetermined position therein, said release slot extends completely through an upper end of said head piece, and said head piece further defines an annular recess which communicates with all of said slots, and said stop is located on said shaft so as to enable travel in said annular recess when said shaft is pivoted in said socket, and said stop is formed to pass through said release slot when said shaft is pivoted in said socket to said release pivot position so that said stop is in said predetermined position under said release slot.

7. A door securing device according to claim 6, wherein said annular recess has an upper wall preventing said stop when in said annular recess from being lifted, thereby preventing withdrawal of the shaft from said socket during pivoting of said shaft in said socket.

8. A door securing device according to claim 6, wherein said slots are disposed angularly around said head piece.

9. A door securing device according to claim 6, wherein said annular recess is formed in a bottom portion of said head piece.

10. A door securing device according to claim 1, wherein said cam is substantially triangular, and substantially horizontally disposed thereby pivoting substantially in a horizontal plane as said shaft is pivoted between said pivot positions of said shaft in said socket.

11. A door securing device according to claim 10, wherein apexes of said cam are rounded.

12. A door securing device according to claim 1, wherein said device comprises a plurality of said cams abutable against said door, and said shaft is connected to said plurality of said cams and extends vertically from a top and bottom of each of said cams.

13. A door securing device according to claim 12, further comprising a bracket secured to a wall or ceiling in which an upper end of said shaft is removably pivotally mounted.

14. A door securing device according to claim 1, wherein said cam and said shaft are formed as a one-piece integral construction unit.

15. A door securing device according to claim 14, wherein said cam and said shaft are made of a single length of metal rod which is bent and spot welded so as to form said cam and shaft as said construction unit.

16. A door securing device according to claim 1, wherein said cam is so shaped with said periphery, and said shaft of said cam is pivotal in said socket in a direction of rotation from its pivot position corresponding to the completely closed position of the door to its respective pivot position corresponding to said at least one partially open position of the door, such that the distance from said shaft to said respective portion of said periphery of said cam which abuts said door decreases continuously and said door is correspondingly enabled to be opened wider as said cam is pivoted in said direction of rotation, whereby said door can be opened from said completely closed position of the door to said at least one partially open position of the door without removing said shaft from said socket with the socket securing the shaft therein and said cam abutting said door against breaking the door in while said cam is pivoted.

17. A method for securing a door with a securing device comprising a cam having a periphery, and a shaft connected thereto for pivotal mounting in a socket adjacent the door such that the cam is abutable against the door preventing against pushing the door in constituting a door security condition, the method comprising the steps of pivoting the shaft in said socket, while in said door security condition, without removal therefrom, in a direction of rotation from a pivot position corresponding to a completely closed position of the door with the cam abutting the door preventing against pushing the door in, to its respective pivot position corresponding to at least one partially open position of the door with the cam abutting the door preventing against pushing the door in, with the distance from said shaft to a respective portion of said periphery of said cam which abuts said door decreasing continuously, and the door is correspondingly enabled to open wider as said cam is pivoted in said direction of rotation, such that the door can be opened from said completely closed position of the door to said at least one partially open position of the door without removing said shaft from said socket, and securing the shaft in the socket against withdrawal therefrom at all times while pivoting the shaft and in said pivot positions of the shaft in the socket such that the cam is abutable against the door securing the door against breaking in.

18. A door securing device according to claim 1, wherein said socket secures the shaft therein for preventing removal therefrom in the respective pivot positions, and therebetween, of said shaft in said socket.

19. A door securing device according to claim 1, wherein said shaft is eccentrically connected to said cam.

20. A door securing device according to claim 1, wherein said shaft is substantially vertically disposed in said socket, and said cam is substantially horizontally disposed thereby pivoting substantially in a horizontal plane as said shaft is pivoted between said selected pivot positions of said shaft in said socket.

* * * * *